United States Patent [19]

Postman et al.

[11] 4,047,344

[45] Sept. 13, 1977

[54] WOOD VENEER WALL COVERING

[75] Inventors: John R. Postman, Portland, Oreg.; Elwin G. Bottorff, Kalama, Wash.

[73] Assignee: Pope & Talbot, Inc., Portland, Oreg.

[21] Appl. No.: 713,861

[22] Filed: Aug. 12, 1976

[51] Int. Cl.[2] ..... E04F 13/00

[52] U.S. Cl. ..... 52/390; 52/311; 52/746; 144/209 R; 144/309 R; 144/315 R; 156/71; 428/106

[58] Field of Search ..... 52/390, 746, 311, 211–213; 144/309 Y, 309 P, 312, 209 R, 309 R; 156/71; 428/106

[56] References Cited

U.S. PATENT DOCUMENTS

| | | | |
|---|---|---|---|
| 71,367 | 11/1867 | Davis | 156/71 |
| 1,394,273 | 10/1921 | Carrier | 144/312 X |
| 1,518,820 | 12/1924 | Romanoff | 52/746 X |
| 1,778,250 | 10/1930 | Elmendorf | 144/309 Y |
| 2,220,898 | 11/1940 | Franklin | 428/106 X |
| 2,498,403 | 2/1950 | Elmendorf | 52/390 X |
| 2,514,318 | 7/1950 | Elmendorf | 144/309 Y |
| 2,578,781 | 12/1951 | Brundage | 428/106 X |
| 3,423,276 | 1/1969 | Eckenroth | 156/71 |
| 3,436,290 | 4/1969 | Reissner | 144/309 X |

FOREIGN PATENT DOCUMENTS

| | | | |
|---|---|---|---|
| 227,479 | 3/1960 | Australia | 144/312 |
| 636,707 | 2/1962 | Canada | 52/390 |
| 965,595 | 8/1964 | United Kingdom | 52/390 |

*Primary Examiner*—Alfred C. Perham

*Attorney, Agent, or Firm*—Kolisch, Hartwell, Dickinson & Stuart

[57] ABSTRACT

Wood veneer wall covering made up of various lengths of veneer strips disposed end-to-end in parallel, diagonal rows over a wall surface.

10 Claims, 6 Drawing Figures

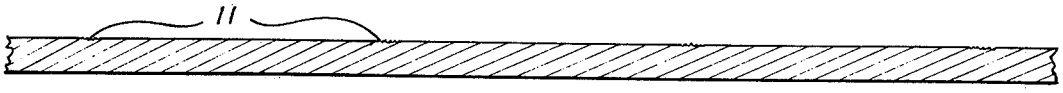
Fig. 4.
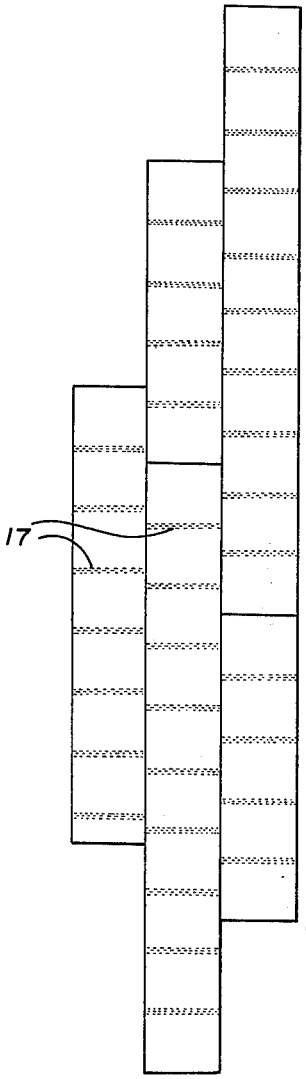
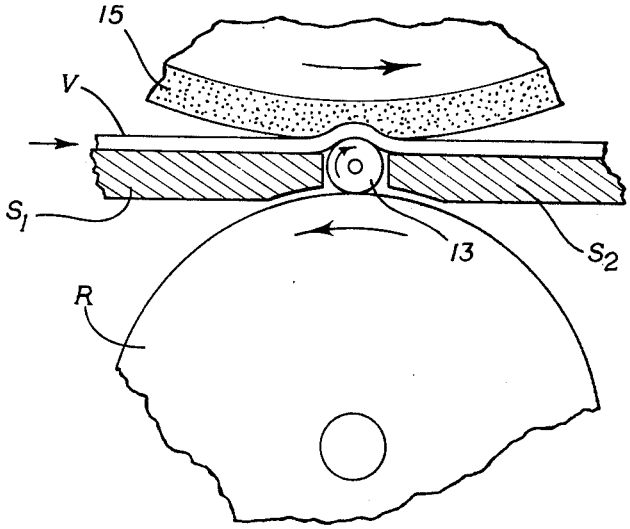
Fig. 5.
Fig. 6.

WOOD VENEER WALL COVERING

This invention relates to wall coverings, and more particularly to a wall covering and means for preparing it utilizing wood veneers.

The use of wood to finish the walls of a room has become an increasingly common practice. While in the past a paneled room was relatively rarely seen, with the advent of prefinished panels and new techniques of coloring and finishing the faces of such panels, one can expect to find a wooden wall covering in substantially any room of a modern house.

In general terms, this invention contemplates a new form of wall covering utilizing wood, which is aesthetically very pleasing, and imparts a unique character to a room featuring the warmth and natural beauty of wood. The covering is readily applied to existing or new wall constructions, and does not require the carpentry skills or equipment needed to install a paneled wall. The covering, like wallpaper, readily conforms to surface irregularities in the plane of the wall. As an additional feature, the covering conceals completely the vertical joint lines that are present in a wall constructed of conventional plaster board or other panels set side-by-side. The covering, furthermore, has a continuity to it which is unobtainable with prefinished panels, the latter conventionally coming in 4 foot by 8 foot or other modular size, and be reason of such shape being customarily limited to vertical placement with vertical joints present where the edge of one panel meets with the edge of an adjacent one. With high walls and conventional panels, vertical stacking of the panels is required.

Describing very generally an embodiment of the wood covering contemplated, such comprises parallel rows of wood veneer strips disposed on the wall. Each row of veneer strips comprises strips of various lengths adhesively bonded to the wall and disposed end-to-end to form the row. The strips have uniform width corresponding to lumber width, or about a 3½ inch width when simulating commercial 4 inch lumber. The strips are relatively thin, typically less than about ⅛ inch thick, whereby they are easily manually bent and easily shaped to curves or other irregularities in the wall from a plane surface.

A method of producing wood veneer comprises cutting such from a log utilizing a lathe. The usual lathe includes a knife which "peels" the veneer from the log and a pressure bar which bears against the outer surface of the log adjacent the knife cooperating with the knife in producing the cut. As a consequence, veneer produced in this manner has a side or face known as a tight side, which is that side of the veneer which forms the outer surface of the log prior to the veneer being peeled from the log. This invention further contemplates the use of lathe cut veneer strips and stress relieving at least the tight faces of these strips. This has the effect of making the strips more limp or pliable, whereby they are more easily cut and applied to the wall surface and whereby they are more readily permanently bonded in place without the strips tending to flex and warp with separation from the wall. The stress relieving may be performed simultaneously with imparting a textured or other type of surface to the tight sides or faces of the strips, and when such is done the stress-relieved strips are applied to the wall with the stress-relieved tight faces facing outwardly.

In the completed wall covering, the ends of the various veneer strips in one row are staggered with respect to the ends of veneer strips in adjacent rows, to eliminate any irregularity in construction suggesting a panel construction. It is further contemplated that the strips be placed on a wall with the rows of strips extending diagonally on the wall. Because of the diagonal disposition of the rows of veneer strips, and because such are adhesively bonded directly to the wall with random lengths in a row and the abutting ends of two lengths of strips in one row staggered with respect to the abutting ends of such strips in other rows, in a completed wall covering, there are no vertical joint lines present such as are found in a panel-type construction. The strips impart a continuous diagonally extending sweep to the wall, suggestive of what might be obtained with diagonally laid out lumber.

Adhesive is readily applied to a face of the strip before applying the strip to the wall, as by using a caulking gun and a conventional paneling adhesive.

A general object of the invention, therefore, is to provide a unique wall covering comprising veneer strips having a width corresponding to the width of the lumber, where such wall covering is a composite of multiple rows of such strips with the ends of strips in adjacent rows being staggered with respect to each other.

A further object of the invention is to provide a unique type of wooden wall covering made from wood veneer strips.

Another object of the invention is to provide a novel method for making a wall of the type described.

A further feature and object is the provision of a wooden wall covering which is effective to conceal vertical and horizontal joint lines found between adjacent panels used in constructing a wall.

Yet another object is to provide a wall covering which is devoid of vertical and horizontal joint lines and appears as a continuous expanse over a wall.

These and other objects and advantages are attained by the invention, and the same is described hereinbelow in conjunction with the accompanying drawings, wherein:

FIG. 4 is a side cross-sectional elevation of a strip, illustrating how such may be stress relieved on the tight side of the face thereof, and at the same time have a textured surface applied to such face;

FIG. 5 illustrates schematically another manner of stress relieving veneer in a strip; and FIG. 6 illustrates portions of a wall covering where veneer strips which have been stress relieved and have had a textural pattern applied thereto make up the covering.

Figure 2:
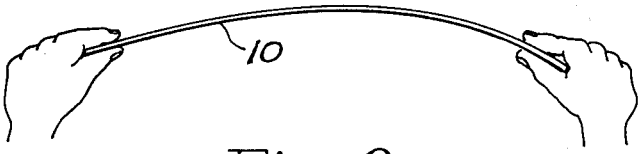
FIG. 2 illustrates the flexibility possessed by a strip whereby the same conforms to curvature and deviations from a plane found in the wall.

As already generally discussed above, the wall covering of the invention is prepared from wooden veneer strips having a width generally corresponding to lumber width and various lengths. By way of specific illustration, the invention has been practiced using veneer strips of various woods, such as cedar, lauan and redwood, of approximately 3½ inch width and lengths ranging from about 1 foot to 4 feet. The veneer strips as demonstrated by strip 10 shown in FIG. 2 are relatively thin, since this imparts flexibility to the strips and enables them easily to be cut to shape as with a pair of household scissors. In the specific example discussed, the veneer strips have a thickness of slightly less than ⅛ inch, which is less than the annual growth of the usual tree.

It is important that the strips be pliable or limp, as this enables them most easily to be handled in applying them to the wall surface being covered. Further, adhesive is utilized in securing the strips to the wall surface, and if the strips are to lie flat without a tendency to warp and pull away at the edges, the strips should be free of stress.

Veneer when it is cut from a log with a lathe has a tight side which is that side or face of the veneer which was the outer surface of the log prior to the cutting. Such tight side is produced by the action of the usual pressure bar found in a lathe, which rolls against the outside of the log adjacent the knife in the lathe compressing the wood where it rolls over the log surface. If such veneer is stress relieved at least on its tight side, strips produced from the veneer have greater flexibility and are easier to apply for reasons already mentioned. Such stress relieving can be done in a number of ways, including roughening or sanding the tight side of the veneer, an operation which not only stress relieves the tight side, but also processes the side to give it an appearance desired in the final wall covering.

Further explaining, veneer may be processed by roughening the tight side or face by subjecting this face to an abrasive action extending across the grain of the veneer. This has the effect of loosening wood fibers to produce a rough-sawn look in the veneer. Any of several procedures which have been developed may be used in this process. For instance, as disclosed in U.S. Pat. No. 2,958,352, the face can be pressed against a saw with actual cutting away of a thin portion of the wood in the face. Alternatively, the face may be passed over rollers with abrasive protrusions on the rollers which roughen the wood with a cross-grain abrasive action.

FIG. 4 illustrates in a somewhat simplified drawing portions of a strip cut from a piece of veneer processed in this manner. Such includes extending across the grain of the veneer and the length of the piece roughen channels such as those shown at 11 imparting to the veneer a rough-sawn look.

FIG. 5 illustrates in a simplified drawing how veneer may be distended to make it pliable or limp. In this instance, both faces of the veneer are ruptured along closely spaced lines paralleling the grain of the veneer which operates to distend or stretch it across the grain. As shown in FIG. 5, a roller R engages and drives a flexing roller 13. On opposite sides of the flexing roller are supporting surfaces S1 and S2. Above the flexing roller is a roller having a layer of resilient material 15 surfacing the roller. When a sheet of veneer, as exemplified by sheet V, is fed in a direction extending across its grain and in the direction of the arrow shown in the figure, the veneer is successively ruptured along its upper and its lower surface.

Lauan and similar woods exhibit considerable expansion and contraction with moisture changes and the processing of lauan veneer as illustrated in FIG. 5 prior to the cutting of strips therefrom has been found to be advantageous. With wood such as redwood which exhibits a tendency to mineral stain prior to drying, the abrading of the veneer to give it a rough-sawn look has particular advantages, as such removes the mineral stain, stress relieves the tight side of the veneer, and also gives a rough-sawn look which in certain applications is aesthetically pleasing.

Figure 3:
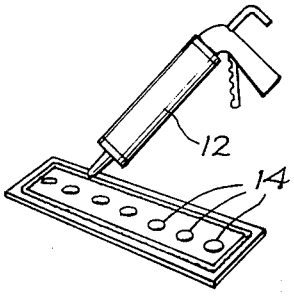
FIG. 3 illustrates how adhesive may be applied to a face of a wood veneer strip prior to applying it to the wall.

Each veneer strip, prior to its being applied to a wall surface, has an adhesive deposit prepared on a face thereof. In the case of a veneer strip which has been stress relieved on its tight side or face only, the deposit is applied to the opposite face. The applying of adhesive to a veneer strip is illustrated in FIG. 3, which shows the use of a caulking gun 12 in applying the paneling adhesive commonly sold in a tube shaped to fit the gun. Deposits may be prepared as indicated at 14, by preparing a bead of adhesive around the perimeter of the strip, with small applications of adhesive down the middle of the strip to assure uniform coverage and a good bond. It has been found in actual practice and by reason of the pliable nature of the strips involved that the adhesive may be applied sparingly.

Figure 1:
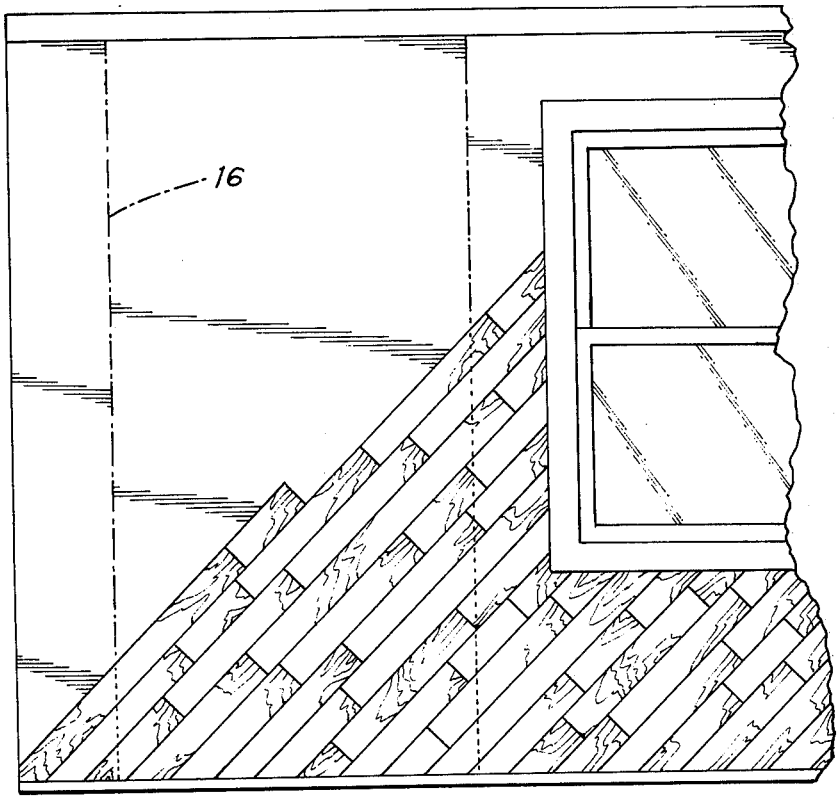
FIG. 1 illustrates portions of a wall in a room, with a wall covering as contemplated in a stage of preparation on such wall.

As shown in FIG. 1, a wood veneer strip is applied to a wall with the longitudinal axis of the strip extending diagonally over the wall surface. In the completed wall covering, the strips appear as rows extending in this diagonal fashion, each row containing strips layed end-to-end along the length of the row. Each strip is applied to the wall with the face of the strip bearing the adhesive pressed against the wall. The strip is pressed into position preferably using a slight sliding motion, to assure an even adhesive coverage. After several strips have been placed, it has been found advantageous to move a pressure roller across the outer face of the strips so as to eliminate air pockets and to assure a solid bond.

Ordinarily it is convenient to apply the strips completing one row at a time. Adjacent the floor or ceiling, where the wall is bounded by a horizontal bounding margin, the strip which is to be fitted in place is cut with scissors in a diagonal cut extending across it, the cut being such that with the strip in place this diagonal cut assumes a horizontal position and coincides with the bounding margin of the wall. Similar diagonal cuts are made in the strips where such come up against corners, windows or other means effective to provide vertical bounding margins to the wall surface covered.

With the covering completed on the wall, the effect partially illustrated in FIG. 1 is produced with the applied strips. In applying the veneer strips to the wall, care may be taken to stagger the adjacent ends of strips in one row with the adjacent ends of strips in other rows. Using strips of various lengths, of course, it is not difficult to produce this staggered effect. A veneer such as cedar by nature will have considerable variations in color, depending upon where the cedar in the veneer was obtained from a log. Appealing contrast in color may also be achieved by proper selection of the veneer strips applied.

It will be noted that in a completed wall covering, and considering a row of strips which extends from the floor to the ceiling, by reason of the diagonal placement of the row, this row will have a length considerably exceeding the height of the wall. This coverage is obtainable with a continuity in the rows of strips which cannot be obtained, for instance, with a conventional 4 foot by 8 foot panel placed on a diagonal against the wall. Such a panel would not have a length sufficient to span the diagonal distance indicated from wall to ceiling, and as a consequence, the end of the panel would appear as a sharp line extending diagonally across the upper reaches of the wall.

It will be noted that with the veneer strips applied, the vertical joint between the structural members, i.e., plaster board panels that usually are employed to form the wall, indicated at 16, is effectively concealed. This is done without introducing other joint lines, such as are present when you cover a wall with adjacent panels. The materials used in covering the wall are conveniently handled, and can be commercialized in bundles which are easily transported from the place of sale to the home where the strips are applied. From a marketing convenience standpoint, therefore, the veneer strip covering contemplated has considerable advantages over other materials such as prefinished panels.

With strips that have been roughened by a cross-grain abrasive action on their tight faces, a rough-sawn textural pattern is produced in the strips with abraded regions extending transversely of the strips. In producing the covering and when the strips are laid end-to-end with ends staggered in adjacent rows, as illustrated in FIG. 6, the cross-grain abrasions 17 in one row are offset with respect to the cross-grain abrasions in adjacent rows, imparting to the wall a random appearance in wood selection contributing to the attractiveness of the wall covering.

What is claimed is:

1. For a wall including vertically disposed structural members forming the plane of the wall, a wood surface covering forming the visible face of the wall comprising multiple elongate wood veneer strips arranged in a diagonal pattern on said wall, each strip having a width corresponding to lumber width and a thickness accommodating manual bending of the strip to accommodate surface irregularities in the plane of the wall, said strips having one set of faces lying against and individually adhesively bonded to the wall and opposed faces facing outwardly from the wall, said strips occupying side-by-side diagonal rows on said wall and rows of strips having strips disposed end-to-end therein with ends of strips in one row being staggered with respect to ends of strips in other rows, the rows of strips extending across any vertical joint line in the structural members forming the wall.

2. The wood surface covering of claim 1, wherein the veneer strips are lathe cut, and said opposed faces of the strips are tight faces of the strips present by reason of the lathe cutting, and said tight faces of the strips are stress relieved.

3. The wall of claim 1, which further includes horizontal bounding margins adjacent the top and bottom of the wall, a row of strips where such terminates at a bounding margin including in the end strip of such row a cut extending diagonally of the end strip which appears as a horizontal cut with the strip on the wall, which cut coincides with the bounding margin.

4. The wall of claim 1, wherein the veneer strips have sawn edges along opposite margins which are in close but nonoverlapping adjacency on said wall.

5. For a wall including vertically disposed structural members forming the plane of the wall, a wood surface covering forming the visible face of the wall, said covering comprising wood veneer strips having a width corresponding to lumber width and a thickness no greater than about the thickness of the annual growth in the wood of the strip, the relatively thin nature of the strip accommodating manual bending of the strip to accommodate surface curvature and irregularities in the plane of the wall, said strips being disposed with one set of faces lying against and adhesively bounded to the wall, said strips occupying side-by-side nonoverlapping rows extending diagonally on the wall with each row containing strips extending longitudinally thereof, said strips being disposed end-to-end in a row and the ends of strips in one row being staggered with respect to the ends of strips in other rows, said wall having bounding margins along the top and bottom of the wall and a row of strips where such terminates at a bounding margin including an end strip which has a cut extending diagonally thereof which appears as a horizontal cut with the strip on the wall with such cut coinciding with the bounding margin.

6. The wood surface covering of claim 5, wherein said wood veneer strips are prepared from lathe-cut wood veneer, the opposite set of faces of the veneer strips are tight faces produced by reason of the lathe cutting of the veneer, and said opposite set of faces of the veneer strips are stress relieved.

7. A method of covering a vertical wall surface having horizontal and vertical bounding margins adjacent top, bottom and sides of the wall comprising:

applying adhesive to one face of an elongate wood veneer strip, said strip having a width corresponding to lumber width and a thickness no greater than the approximate annual growth of the wood in the strip, the relatively thin nature of the strip accommodating manual bending of the strip to accommodate surface curvatures and irregularities in the plane of the wall, applying the strip to the wall surface with its adhesive face against the wall, positioning the strip on the wall when applying the same with the strip extending diagonally on the wall, applying adhesive to faces of other veneer strips of the same width and thickness but of varying lengths and applying such other strips to the wall with positioning of such strips in the same manner as performed with the first-mentioned strip, the strips collectively being arranged in adjacent but nonoverlapping rows with strips end-to-end in a row and the ends of strips in one row being staggered with respect to the ends of strips in adjacent rows, the strips where such terminate at horizontal and vertical margins of the wall having diagonal cuts prepared therein which cuts after placement of the strips coincide with such margins.

8. In the covering of a wall surface, the method comprising preparing lathe-cut wood veneer strips having a width corresponding to lumber width and a thickness no greater than about the annual growth in the wood of the strip, said wood veneer strips having one set of faces which are tight faces by reason of the lathe cutting, stress relieving at least the tight faces of the wood strips, applying the strips to the wall surface with the stress-relieved faces facing outwardly and with adhesive applied to opposite faces to bond the opposite faces to the wall surface, said application of the strips being performed with the strips arranged in adjacent rows with strips end-to-end in a row and with the ends of strips in one row staggered with respect to the ends of strips in other rows.

9. The method of claim 8, wherein stress relieving is performed by roughening the tight faces of the strips with a cross grain abrasive action.

10. The method of claim 8, wherein the roughening produces a cross grain textural pattern and the strips are applied to the wall surface with an offset in the textural pattern of strips occupying adjacent rows.

* * * * *